US007248674B2

(12) United States Patent
Groh et al.

(10) Patent No.: US 7,248,674 B2
(45) Date of Patent: Jul. 24, 2007

(54) DIAPHRAGM UNIT FOR AN X-RAY DEVICE

(75) Inventors: Burkhard Groh, Chicago, IL (US); Mathias Hörnig, Erlangen (DE); Bernhard Sandkamp, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 11/076,744

(22) Filed: Mar. 10, 2005

(65) Prior Publication Data

US 2005/0201521 A1 Sep. 15, 2005

(30) Foreign Application Priority Data

Mar. 11, 2004 (DE) ..... 10 2004 012 050

(51) Int. Cl.
*G21K 1/02* (2006.01)
*G21K 1/04* (2006.01)

(52) U.S. Cl. ..... 378/147; 378/150

(58) Field of Classification Search ..... 378/145–160, 378/196, 197, 205
See application file for complete search history.

(56) References Cited

U.S. PATENT DOCUMENTS

| | | | | |
|---|---|---|---|---|
| 4,031,401 | A * | 6/1977 | Jacob | 378/146 |
| 4,097,748 | A * | 6/1978 | Monvoisin | 378/146 |
| 4,203,037 | A * | 5/1980 | Gur et al. | 378/37 |
| 4,361,899 | A * | 11/1982 | Amplatz | 378/21 |
| 4,490,835 | A * | 12/1984 | Wons | 378/146 |
| 4,875,226 | A * | 10/1989 | Plewes | 378/146 |
| 5,164,976 | A * | 11/1992 | Scheid et al. | 378/146 |
| 5,406,611 | A * | 4/1995 | Schobert et al. | 378/152 |
| 5,500,884 | A * | 3/1996 | Guenther et al. | 378/38 |
| 6,422,749 | B1 * | 7/2002 | Polkus et al. | 378/205 |
| 6,735,280 | B2 | 5/2004 | Horbaschek | |
| 6,850,596 | B2 * | 2/2005 | Sundermann et al. | 378/147 |
| 2004/0066885 | A1 * | 4/2004 | Ogawa | 378/42 |
| 2005/0169431 | A1 | 8/2005 | Groh et al. | |
| 2005/0169432 | A1 | 8/2005 | Groh et al. | |

FOREIGN PATENT DOCUMENTS

| | | |
|---|---|---|
| DE | 32 46 114 | 6/1984 |
| DE | 39 28 282 A1 | 6/1991 |
| DE | 197 55 764 A1 | 6/1999 |
| DE | 101 33 657 A1 | 1/2003 |
| DE | 10 2004 004 629 A1 | 8/2005 |
| DE | 10 2004 004 630 A1 | 8/2005 |

* cited by examiner

*Primary Examiner*—Edward J. Glick
*Assistant Examiner*—Irakli Kiknadze

(57) ABSTRACT

The invention relates to a diaphragm unit 4 or a diaphragm unit 4 and an associated x-ray emitter 1 with adjustment option for displaying an asymmetrical area under examination, with the diaphragm unit 4 being able to be tilted in accordance with the invention relative to the x-ray emitter 1, preferably by moving it on a rail system 12 attached isocentrically to the tube focus 9 on the tube housing 2 and/or the unit 1;4 made up of diaphragm unit 4 and x-ray emitter 1 being able to be tilted isocentrically to the tube focus 9 of the x-ray tube 2.

12 Claims, 3 Drawing Sheets

DIAPHRAGM UNIT FOR AN X-RAY DEVICE

CROSS REFERENCE TO RELATED APPLICATIONS

This application claims priority to the German application No. 10 2004 012 050.1, filed Mar. 11, 2004 which is incorporated by reference herein in its entirety.

FIELD OF INVENTION

The invention relates to a diaphragm unit for an x-ray emitter and an x-ray device having a diaphragm unit, wherein an examination area can be at least partly exposed to the x-ray emitter.

BACKGROUND OF INVENTION

X-ray systems are equipped with diaphragms which are used for variably restricting the x-rays to the required height and width. The undesired x-ray components are absorbed by the diaphragm blades which are normally made of lead. The diaphragms of such x-ray devices normally feature two pairs of lead blades. These pairs of blades are activated symmetrically to the center of the detector and isocentrically to the x-ray tube. The plate-type diaphragm blades cannot just be enlarged as required since this would also enlarge the aperture which for example leads to limitations in angulations on a C-arm of the x-ray device. An asymmetric display of an area under examination by means of a mechanical movement of the detector or the C-arm is known from DE 101 33 657 A1.

SUMMARY OF INVENTION

It is therefore an object of the invention to adjust the area of the image that can be displayed, especially by expanding it asymmetrically in a simple manner.

This object is achieved by the claims.

The diaphragm unit in accordance with the invention or the diaphragm unit and the x-ray emitter in accordance with the invention or the inventive method for adjusting a diaphragm unit or a diaphragm unit and an x-ray emitter offer expanded options for adjusting the area able to be displayed. The user is therefore not exclusively confined to the conventional symmetrical settings. With the present invention different sized areas of the detector can be displayed in different forms as well as at different positions in a particularly simple way. This variability of the display areas is especially advantageous if patients are not to be examined in standard positions. A further advantage of the invention lies in the fact that existing diaphragms can continue to be used. Only the mechanical control and linkage for the inventive adjustment of diaphragm unit or diaphragm unit and x-ray emitter have to be expanded.

In accordance with the first embodiment of the invention the diaphragm unit and the x-ray emitter constitute one unit which can be tilted in its entirety such that the area under investigation can be displayed asymmetrically. This embodiment offers a particularly simple construction since only one mechanism for tilting the otherwise unchanged unit has to be provided but no modifications have to be made to the x-ray emitter and diaphragm unit. The unit is advantageously able to be tilted isocentrically to the tube focus. The retention of the x-ray tube focus brings the advantage that the scatter ray grid in front of the detector for reduction of scatter rays can continue to be used.

In a further embodiment of the invention there is provision for the diaphragm unit to be moveable in a circumferential direction of an x-ray housing accommodating the x-ray emitter relative to the former An especially simple construction here provides a system which advantageously moves isocentrically to the tube focus; This allows the diaphragm unit to be tilted relative to the x-ray emitter and the distance between diaphragm unit and tube focus to remain unchanged. Expediently the diaphragm unit is only moved far enough to remain in the exit opening of the X rays. With the inventive tilting of the diaphragm unit edge areas of the detector can also be displayed which is not achievable with the conventional design.

BRIEF DESCRIPTION OF THE DRAWINGS

The invention as well as further advantageous embodiments in accordance with features of the subclaims are explained in more detail below with reference to schematic exemplary embodiments in the drawing; The Figures show:

FIG. 1 a conventional arrangement consisting of diaphragm unit and x-ray emitter viewed from the side, FIG. 2 the arrangement in accordance with FIG. 1 viewed from below, FIG. 3 an inventive exemplary embodiment viewed from the side, FIG. 4 an inventive exemplary embodiment in a symmetrical starting position viewed end-on.

In accordance with FIG. 1 to FIG. 3, in an—emitter housing 6 only shown in FIG. 3 an x-ray emitter 1 with an anode 3 provided in a surrounding tube housing 2 and with a diaphragm unit 4 provided in the area of the exit opening 5 of the x-rays is arranged. FIG. 1 and FIG. 2 show—with the x-ray housing omitted to aid clarity—a conventional arrangement for displaying symmetrical areas under examination. To make the diagram clearer FIG. 1 shows the axis of symmetry 13. The anode 3 is usually a rotatable anode. From the tube focus 9 at the anode 3 as source, the emitted X rays leave the x-ray housing 2 in the direction of the axis of symmetry 13 through an exit opening 5 and enter the diaphragm unit 4.

Figure 1:
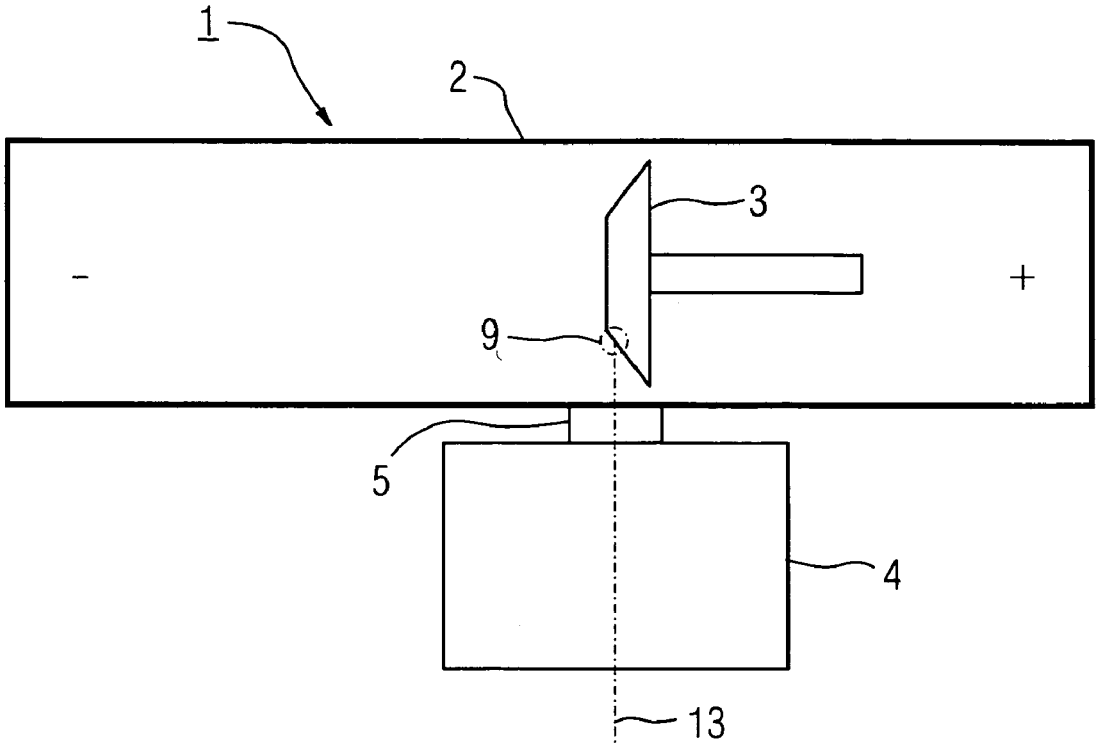
Figure 2:
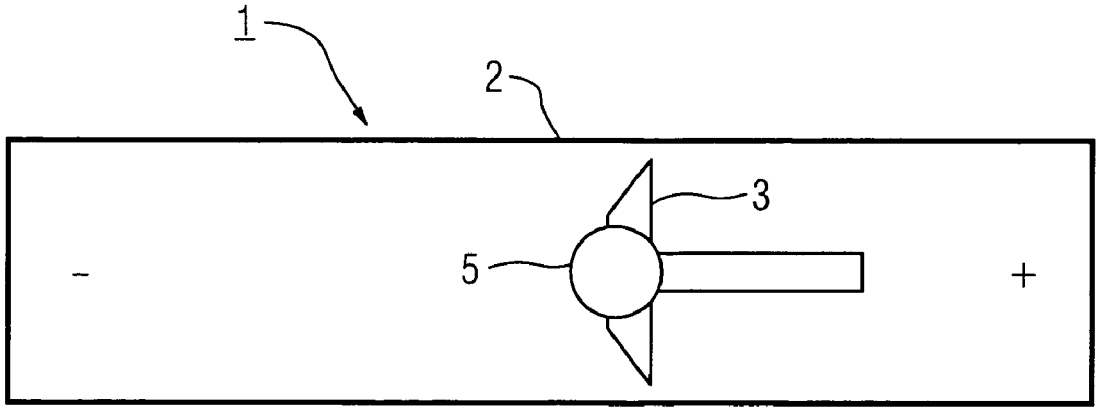
Figure 3:
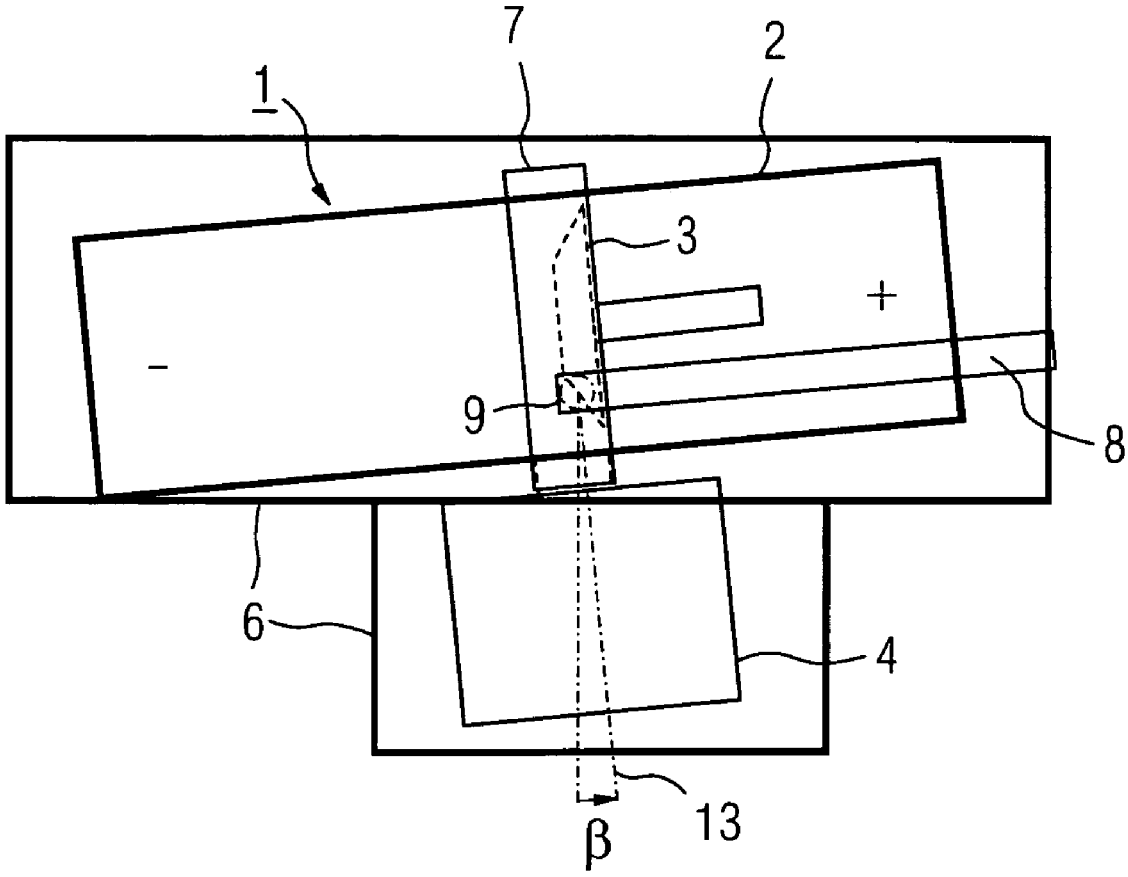

The constructional unit 1;4 in accordance with the invention shown in FIG. 3, consisting of diaphragm unit 4 and x-ray emitter 1 is attached by means of a tube hanger 7 to a swivel arm 8. The swivel arm 8 is arranged so that a tilting of the entire unit 1;4 by means of the swivel arm 8 around the tube focus 9 of the x-ray tube is guaranteed. The unit 1;4 is tilted in FIG. 3 in comparison to FIG. 1 by an angle relative to the angle of symmetry 13. Tilting by means of the swivel arm 8 provides a particularly simple design. The swivel arm 8 can also be made easier to handle by including an external power drive, especially an electric motor. It is sensible to provide control facilities for the external power drive by means of a control unit which is preferably able to be integrated into the existing x-ray unit controller. This provides the opportunity of combining the tilting of the unit and the operation of overall x-ray device into one controller.

Figure 5:
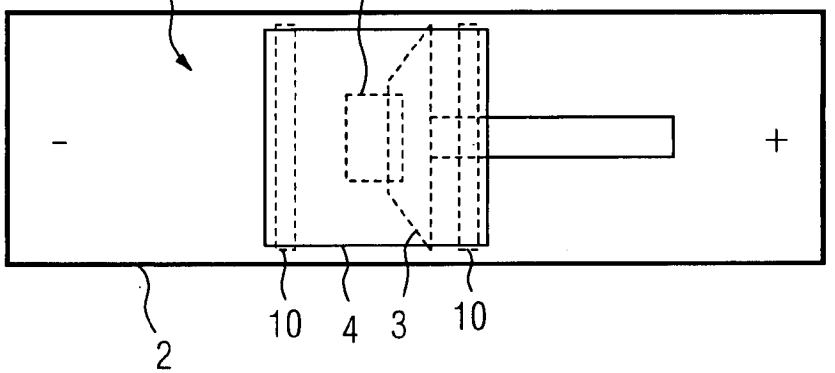
FIG. 5 the arrangement in accordance with FIG. 4 rotated by 90° from below FIG. 6 an inventive exemplary embodiment adjusted asymmetrically viewed end-on, FIG. 7 the arrangement in accordance with FIG. 6 rotated by 90° viewed from below.
Figure 4:
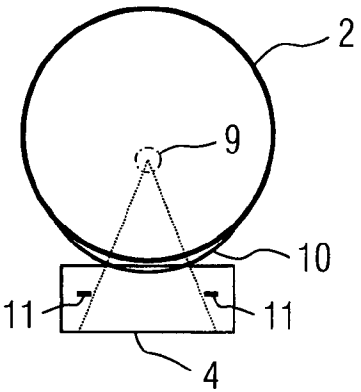

FIG. 4 shows the end-on view on an x-ray housing 2, to which a rail system 10 is attached on which the diaphragm unit can be moved and is thus able to be tilted relative to the x-ray emitter 1. The rail system 10 runs preferably isocentrically to the tube focus 9 of the x-ray emitter 1. In a known way the area of the x-ray exit 12 in accordance with FIG. 5 is defined by the diaphragm blades 11.

Figure 7:
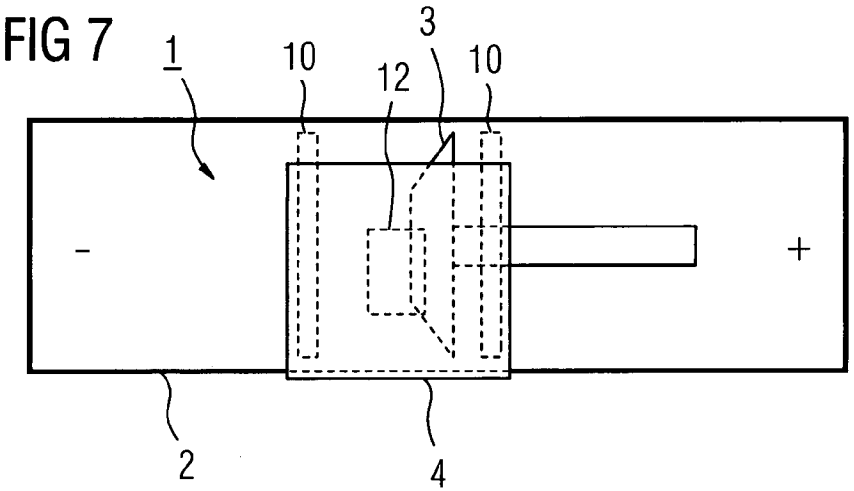
Figure 6:
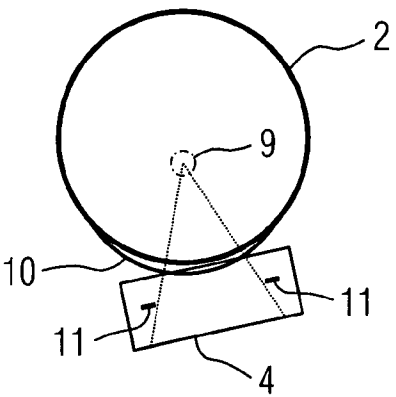

If the diaphragm unit 4 is moved in accordance with the invention on the rail system 10 from the position shown in FIG. 4 into a position in accordance with FIG. 6 and thereby tilted relative to the x-ray emitter 1, the x-ray exit 12 changes in accordance with FIG. 7 and makes an asymmetrical display of image areas possible using unchanged diaphragm blades 11. Advantageously the movability is to be made easier by an external drive, especially by an electric motor and a control not shown separately here. In accordance with an embodiment of the invention, the control is able to be integrated into the control of the x-ray device.

The invention can be briefly summarized as follows: the invention relates to a diaphragm unit 4 or a diaphragm unit 4 and an associated x-ray emitter 1 with an adjustment option for displaying an asymmetrical area under investigation, with the diaphragm unit 4 being able to be titled in accordance with the invention relative to the x-ray emitter 1, preferably by movement on a rail system 10 attached isocentrically to the tube focus 9 on the tube housing 2, and/or the unit 1;4 made up of diaphragm unit 4 and x-ray emitter 1 being able to be tilted isocentrically to the tube focus 8 of the x-ray tube 2.

The invention claimed is:

1. A diaphragm unit for use in an x-ray device of the type having an x-ray emitter positioned in a housing, comprising an assembly unit allowing for rotational movement of the diaphragm unit about the housing, so that the assembly unit isocentrically translates the diaphragm unit in its entirety about a source point of the x-ray emitter, allowing an asymmetrical part of an examination area to be irradiated by the x-ray emitter using the diaphragm unit.

2. The diaphragm unit according to claim 1, wherein the assembly unit includes a guide rail for moving the diaphragm unit along a path always equidistant from the source point of the x-ray emitter.

3. The diaphragm unit according to claim 1, further comprising an electric motor for powering rotational movement of the diaphragm unit about the housing.

4. An x-ray device, comprising:

an x-ray emitter; and a diaphragm unit arranged on an assembly unit and facing the x-ray emitter for fading in an examination area, wherein the assembly unit is configured to isocentrically rotate the diaphragm unit about the x-ray emitter so that an asymmetrical examination area is irradiated by the x-ray emitter.

5. The x-ray device according to claim 4, wherein components of the diaphragm unit do not change position relative to one another while the assembly unit is rotated.

6. The x-ray device according to claim 4, wherein the x-ray emitter includes a source point from which an axis of symmetry extends;

wherein x-rays travel from the source point; along the axis of symmetry and through an exit opening of the emitter; and wherein the diaphragm unit and the x-ray emitter form one integrated unit which can be tilted in the entirety about the source point to thereby rotate the axis of symmetry.

7. The x-ray device according to claim 6, further including a housing surrounding the emitter and a hanger assembly connecting the emitter to the housing to effect tilting of the integrated unit about the source point so that an asymmetrical part of an examination area to be irradiated by the x-ray emitter can be exposed to the x-ray emitter.

8. The x-ray device according to claim 7, wherein the hanger assembly includes a swivel arm for tilting the integrated unit.

9. The diaphragm unit according to claim 4, further comprising a guide rail for moving the diaphragm unit.

10. The diaphragm unit according to claim 9, wherein the guide rail is arranged isocentrically relative to the source point of the x-ray emitter.

11. The x-ray device according to claim 4, further comprising an electric motor for powering isocentric rotation of the diaphragm unit about the x-ray emitter.

12. A method of adjusting a diaphragm unit of the type which receives radiation from an x-ray emitter in order to effect fading in an examination area to be irradiated by the x-ray emitter, the method including the steps of:

connecting an assembly unit to provide a rotational path about a source point of the emitter; and connecting the diaphragm unit to the assembly unit for movement along the rotational path and about the x-ray emitter so that an asymmetrical part of the examination area is exposed to the radiation by moving the diaphragm unit.

* * * * *